US007694558B2

(12) United States Patent
Zaeper et al.

(10) Patent No.: US 7,694,558 B2
(45) Date of Patent: Apr. 13, 2010

(54) DOWNHOLE WASHOUT DETECTION SYSTEM AND METHOD

(75) Inventors: Ralf Zaeper, Hannover (DE); John D. Macpherson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 8 days.

(21) Appl. No.: 12/028,913

(22) Filed: Feb. 11, 2008

(65) Prior Publication Data

US 2009/0200079 A1 Aug. 13, 2009

(51) Int. Cl.
*E21B 47/06* (2006.01)
*E21B 21/08* (2006.01)

(52) U.S. Cl. ..... 73/152.51; 73/152.21; 73/152.22

(58) Field of Classification Search ..... 73/152.43, 73/152.46, 152.51, 152.21, 152.22
See application file for complete search history.

(56) References Cited

U.S. PATENT DOCUMENTS

| | | | | |
|---|---|---|---|---|
| 3,838,279 | A | 9/1974 | Schultz et al. | |
| 4,346,594 | A * | 8/1982 | Owings | 73/152.19 |
| 4,430,892 | A * | 2/1984 | Owings | 73/152.21 |
| 5,415,037 | A * | 5/1995 | Griston et al. | 73/152.12 |
| 5,530,243 | A * | 6/1996 | Mathis | 250/269.3 |
| 5,659,169 | A * | 8/1997 | Mickael et al. | 250/269.3 |
| 6,233,524 | B1 * | 5/2001 | Harrell et al. | 702/9 |
| 6,257,354 | B1 * | 7/2001 | Schrader et al. | 175/38 |
| 6,272,434 | B1 * | 8/2001 | Wisler et al. | 702/9 |
| 7,044,239 | B2 * | 5/2006 | Pinckard et al. | 175/57 |
| 7,054,750 | B2 | 5/2006 | Rodney et al. | |
| 7,128,167 | B2 | 10/2006 | Dunlop et al. | |
| 2004/0149471 | A1 | 8/2004 | Hall et al. | |
| 2005/0200498 | A1 | 9/2005 | Gleitman | |
| 2006/0260801 | A1 | 11/2006 | Hall et al. | |
| 2007/0126596 | A1 | 6/2007 | Hall et al. | |
| 2008/0135293 | A1 * | 6/2008 | Tashiro et al. | 175/45 |
| 2008/0236814 | A1 * | 10/2008 | Roddy | 166/250.01 |

OTHER PUBLICATIONS

Finger et al. "Slimhole Drilling, Logging, and Completion Technology—An Update," Jun. 10, 2000, Proceedings World Geothermal Congress 2000, ppg 2335-2339.*

Gaynor, Tom M., et al. "Tortuosity versus Micro-Tortuosity—Why Little Things Mean a Lot," Sperry-Sun Drilling Services, a Halliburton Company, SPE/IADC 67818, SPE/IADC Drilling Conference, Amsterdam, The Netherlands, Feb. 27, 2001-Mar. 1, 2001, pp. 1-12.

Aldred, et al. "Managing Drilling Risk." Oil Field Review, Summer 1999. 18 pages.

* cited by examiner

*Primary Examiner*—John Fitzgerald
(74) *Attorney, Agent, or Firm*—Cantor Colburn LLP

(57) ABSTRACT

Disclosed herein is a method of detecting a downhole washout. The method includes, positioning a plurality of sensors along a downhole drillstring, communicatively coupling the plurality of sensors to a processor, and analyzing data sensed by the plurality of sensors with the processor for relationships indicative of a washout.

21 Claims, 2 Drawing Sheets

DOWNHOLE WASHOUT DETECTION SYSTEM AND METHOD

BACKGROUND OF THE INVENTION

In the hydrocarbon recovery industry any loss of efficiency can be costly to a well operator. For example, a washout of a drill string or a formation while drilling can allow pumped mud to flow at rates other than the flow rates at which an operator believes they are flowing. Additionally, a washout can cause mud to flow to locations other than where the operator desires it to flow. Such conditions can cause issues during drilling due to a lack of mud flowing through the bit, for example. Methods and systems for detecting washouts as soon as they occur are therefore valuable to well operators.

BRIEF DESCRIPTION OF THE INVENTION

Disclosed herein is a method of detecting a downhole washout. The method includes, positioning a plurality of sensors along a downhole drillstring, communicatively coupling the plurality of sensors to a processor, and analyzing data sensed by the plurality of sensors with the processor for relationships indicative of a washout.

Further disclosed herein is a downhole drillstring washout detection system. The system includes, a plurality of sensors positioned downhole along a drillstring for measurement of at least one parameter therewith, a communication medium coupled to the plurality of sensors, and a processor coupled to the communication medium. The processor configured to receive data from at least the plurality of sensors, the processor further configured to determine relationships of sensed data indicative that a washout has occurred.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
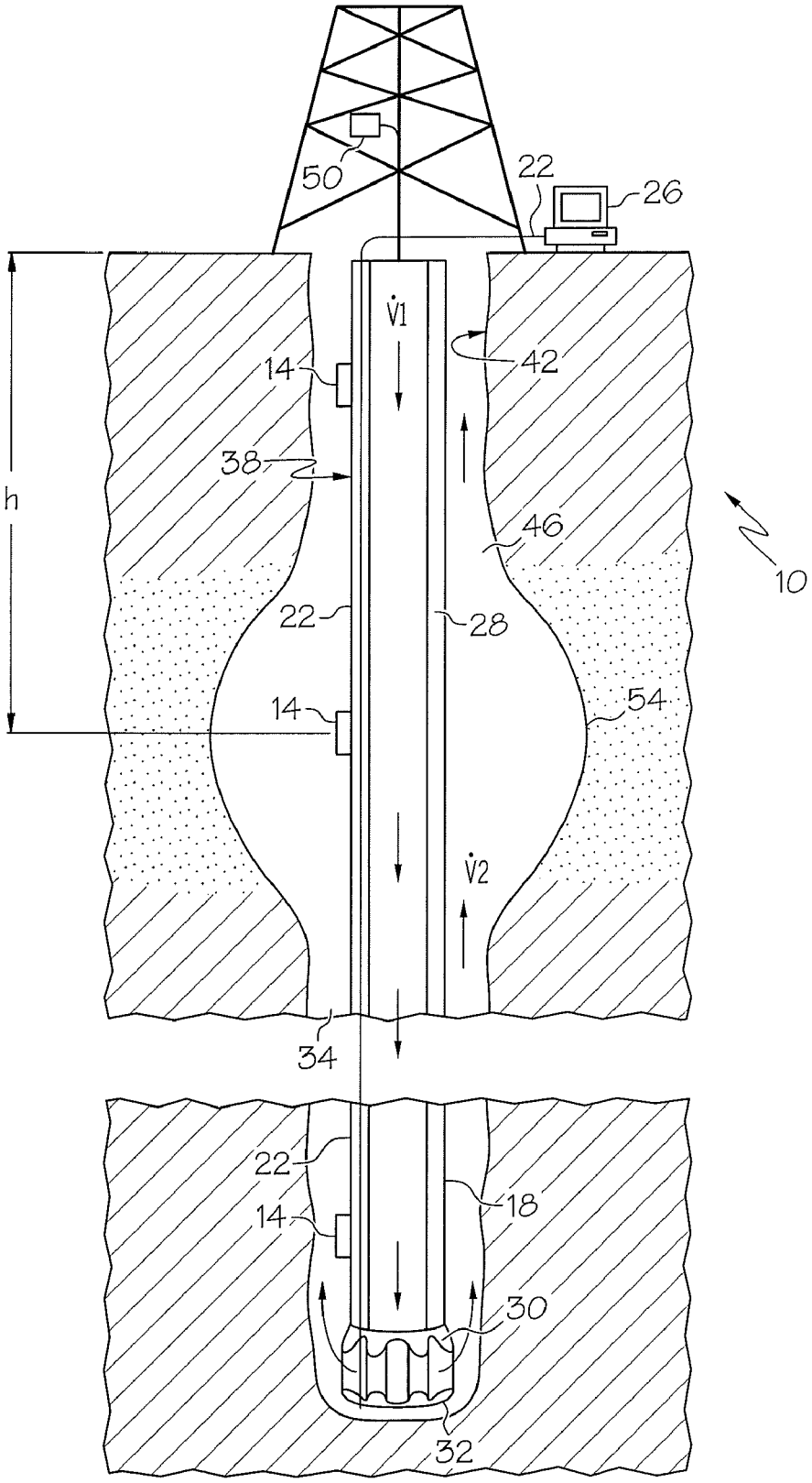
FIG. 1 depicts a washout detection system disclosed herein applied at a drillstring within a wellbore with a formation washout.

Referring to FIG. 1, an embodiment of a washout detection system 10 disclosed herein is illustrated. The washout detection system 10 includes, a plurality of pressure sensors 14 positioned along a drillstring 18, a communication medium 22 coupled to the plurality of pressure sensors 14, and a processor 26 that is also coupled to the communication medium 22. The communication medium 22 provides operable communication between the pressure sensors 14 and the processor 26 and can include a wired pipe 28, for example, which permits high bandwidth data transmission there through. As such, the processor 26 can be located at surface, as disclosed herein or at some other location along the drillstring 18, such as in a bottom hole assembly 30, for example, while monitoring the pressure sensors 14.

Positioning the pressure sensors 14 in an annulus 34 between an outer surface 38 of the drillstring 18 and an inner surface 42 of a wellbore 46, regardless of whether the wellbore 46 has a liner or not, allows for continuous monitoring of pressure at various wellbore depths within the annulus 34. Such monitoring can be performed while drilling and while mud is being pumped downhole by a mud pump 50, shown located at surface in this embodiment. Mud flowing back uphole through the annulus 34, after flowing out through a bit 32, will affect the pressure sensed by the pressure sensors 14. Through the use of Bernoulli's Principle, which is based on conservation of energy, a relationship between pressure in the annulus 34 and area of the annulus 34 can be formed. Changes in flow area of the annulus 34 can, therefore, be determined and monitored for increases indicative of a formation washout 54 characterized by an increased flow area of the annulus 34. Other mathematical models of the flow-pressure relation might be used in case of turbulent or mixed flow according to the local Reynold's number.

For a well without mud losses or fluid influx from the formation the mud volumetric flow rate, $\dot{V}_1$, from the mud pump 50 will be constant whether flowing down through the drillstring 18 or returning to surface through the annulus 34, $\dot{V}_2$.

$$\dot{V}_1=\dot{V}_2 \tag{1}$$

and since:

$$\dot{V}_1=A_1V_1 \tag{2}$$

$$\text{and } \dot{V}_2=A_2V_2 \tag{3}$$

then:

$$A_1V_1=A_2V_2 \tag{4}$$

where:

A is the cross sectional flow area, and

V is the flow velocity.

Further, according to Bernoulli's Equation:

$$\frac{1}{2}\rho V^2 + P + \rho g h = P_o = \text{constant sufficient long enough and laminar flow}, \tag{5}$$

where:

ρ=density of the mud, g=earth's gravitational acceleration, h=vertical depth, and P=pressure.

Additionally, $P_0$ can be determined for V=0 and h=0, for example.

Since the cross sectional area of the annulus 34 is needed to determine when a washout 54 has occurred, the equations are manipulated and solved for the area of the annulus 34 at a depth of h.

$$A_h = \left[\frac{\rho \dot{V}_{ref}}{2(P_0 - P_h + \rho g h)}\right]$$

where, h, g and ρ are determined and known, $A_h$=cross sectional area at depth h, $\dot{V}_{ref}$=constant reference flow determined by the mud pump 50, and $P_h$=pressure at depth h Thus, the cross sectional area of the annulus 34 at a given depth is a function of the flow rate and the pressure measured at that depth. These formulae are most accurate for idealized conditions that are assumed to be held true during measurements; mud flow is constant, mud density is constant, flow in the annulus 34 is laminar and the mud is incompressible. More sophisticated models may describe the physical behavior even better as disclosed below. As such, the washout detection system 10 monitors pressure at the pressure sensors 14 and calculates a corresponding annular area at the depths of each of the pressure sensors 14. In response to the detection system 10 calculating an area greater than a selected value, the washout detection system 10 issues may sound an alert indicating that the washout 54 has occurred.

In alternate embodiments numerical models of the physical parameters could be used to derive a functional relationship between the pressure, $P_h$, at the downhole location and the area, $A_h$, of the annulus 34.

Figure 2:
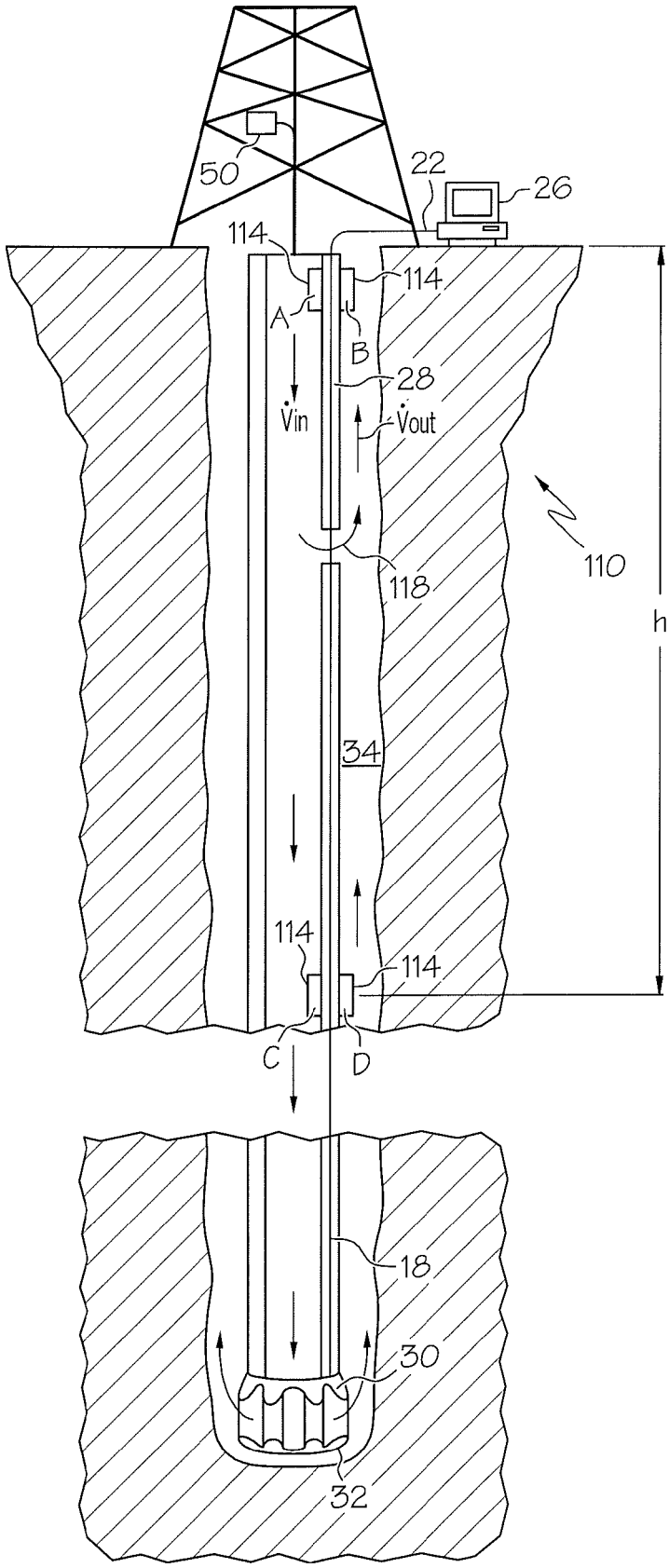
FIG. 2 depicts a washout detection system disclosed herein applied to a drill string with a washout formed therein.

Referring to FIG. 2, another embodiment of a downhole drillstring washout detection system 110 disclosed herein is illustrated. Wherein the detection system 10 was directed at detecting washouts in the walls of a wellbore or a wellbore lining, the detection system 110 is directed to detecting a washout in the wall of a portion of the drillstring 18 itself such as a section of pipe, for example characterized by a hole therethrough through which flow can escape. The washout detection system 110 includes, a plurality of sensors 114 positioned along a drillstring 18, a communication medium 22 coupled to the plurality of sensors 114, and a processor 26 that is also coupled to the communication medium 22. The communication medium 22 provides operable communication between the sensors 114 and the processor 26 and can include a wired pipe 28, for example, which permits high bandwidth data transmission therethrough. As such, the processor 26 can be located at surface, as disclosed herein or at some other location along the drillstring 18, such as in a bottom hole assembly 30, for example, while monitoring the sensors 114.

In this embodiment, four of the sensors 114 are located at points A, B, C and D. Point A is inside the drillstring 18 at a depth $h_A$, which may be at surface level, point B is outside the drillstring 18 at a depth $h_B$, which may be at surface level, point C is inside the drillstring 18 at a depth $h_C$, while point D is outside the drillstring 18 at a depth $h_D$. Note, although illustrated herein points C and D are at the same depth, alternate embodiment may have points C and D at different depths. The sensors 114 can be pressure sensors or flow sensors. An embodiment wherein the sensors 114 are pressure sensors will be discussed first.

In normal operation of a well the flow of mud from the mud pump 50 is down through the inside of the drillstring 18, through the bit 32 and up through the annulus 34 and back to the surface. For a well without mud losses or fluid or gas influx the volumetric flow rate, $\dot{V}_{in}$, into the well is equal to the volumetric flow rate, $\dot{V}_{out}$, out of the well. The flow areas can be assumed known well enough and locally constant. According to Bernoulli's Equation:

$$P = P_0 - \rho g h - \frac{1}{2}\rho V^2 = P_o - \rho g h - \frac{1}{2}\rho\left[\frac{\dot{V}}{A_h}\right]^2 \quad 7$$

Pressure, therefore, with $\dot{V}$=constant (long enough), A=constant, Rho=locally constant and g=constant for the well location, will only vary with depth h. Since depth is known, the change in pressure resulting from the depth is known as well.

By monitoring the pressures at different depths a washout 118 in the drillstring 18 can be detected. For example, the washout 118 in FIG. 2 allows mud to flow from inside the drillstring 18 to outside the drillstring 18 at a depth below points A and B but above points C and D. As such, the pressure at these four points will vary from the initial pressures, $P_0$, as follows:

$$P_A = P_{A_0},\ P_B \approx P_{B_0},\ P_C < P_{C_0},\ P_D < P_{D_0} \quad 8$$

with $P_A$ held constant by the mud pumps.

The processor 26 can, therefore, through observation of a change in pressure sensed by one of the sensors 114, detect that a washout 118 has occurred. The processor 26 can issue an alert in response to detection of the washout 118 so that an operator may initiate a response. Additionally, a magnitude of the washout 118 will be related to the change in pressure encountered and, as such, a magnitude of the washout 118 can be approximated therefrom. The depth at which the washout 118 occurred can be determined by the location of the one or more sensors 14 for which the pressure readings have changed. Having more sensors 14 with closer spacing therebetween will increase the resolution through which the washout 118 is located.

In an alternate embodiment the washout detection system 110 can employ sensors 114 that are flow sensors instead of pressure sensors. The flow sensors 114 in this embodiment measure volumetric mud flow directly, $\dot{V}$. As such, a redirection of flow, for example, through the washout 118 in a wall of the drillstring 18, will be detectable by the flow sensors 114 positioned below the washout 118 due to changes in flows sensed thereby. In contrast, flow sensors 114 above the washout will not sense a change in flow. Thus:

$$\dot{V}_A = \dot{V}_{A_0},\ \dot{V}_B = \dot{V}_{B_0},\ \dot{V}_C < \dot{V}_{C_0},\ \dot{V}_D < \dot{V}D_0 \quad 9$$

With such information the processor 26, by knowing the locations of the flow sensors 114 along the drillstring 18, can determine a location of the washout 118 along the drillstring 18. Additionally, by calculating a change in the flow rate sensed the processor 26 can determine the flow rate through the washout 118 and thus the severity of the washout 118.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method of detecting a downhole washout, comprising:

positioning a plurality of sensors along a downhole drillstring;

communicatively coupling the plurality of sensors to a processor; and analyzing data sensed by the plurality of sensors with the processor for relationships indicative of a washout including calculating a flow area with the data sensed.

2. The method of detecting a downhole washout of claim 1, wherein the communicatively coupling includes connecting the plurality of sensors with wired pipe.

3. The method of detecting a downhole washout of claim 1, further including assuming density of fluid sensed with the plurality of sensors is constant.

4. The method of detecting a downhole washout of claim 1, further comprising assuming volumetric flow rates of fluid sensed with the plurality of sensors are constant.

5. The method of detecting a downhole washout of claim 1, further comprising assuming that fluid sensed with the plurality of sensors is incompressible.

6. The method of detecting a downhole washout of claim 1, further comprising assuming that fluid sensed by the plurality of sensors is mud.

7. The method of detecting a downhole washout of claim 1, further comprising issuing an alert that the washout had occurred.

8. The method of detecting a downhole washout of claim 1, wherein positioning a plurality sensors includes positioning a plurality of pressure sensors.

9. The method of detecting a downhole washout of claim 1, further comprising assuming that flow through the flow area is a combination of laminar and turbulent.

10. The method of detecting a downhole washout of claim l, wherein the calculating includes calculating an annular flow area between the drillstring and a wellbore.

11. The method of detecting a downhole washout of claim 10, further comprising assuming that flow through the annular flow area is laminar.

12. The method of detecting a downhole washout of claim 10, further comprising assuming that flow through the annular flow area is turbulent.

13. The method of detecting a downhole washout of claim 1, wherein the positioning the plurality of sensors includes positioning a plurality of flow sensors.

14. The method of detecting a downhole washout of claim 1, further comprising determining the washout is a hole through the drillstring.

15. The method of detecting a downhole washout of claim 14, further comprising calculating a flow rate through the washout.

16. A method of detecting a downhole washout, comprising:

positioning a plurality of sensors along a downhole drillstring;

communicatively coupling the plurality of sensors to a processor;

analyzing data sensed by the plurality of sensors with the processor for relationships indicative of a washout; and calculating changes in flow area based upon changes in pressure measured with the plurality of pressure sensors.

17. A method of detecting a downhole washout, comprising:

positioning a plurality of sensors along a downhole drillstring;

communicatively coupling the plurality of sensors to a processor;

analyzing data sensed by the plurality of sensors with the processor for relationships indicative of a washout; and locating the washout based upon data sensed by the plurality of sensors.

18. The downhole drillstring washout detection system of claim 17, wherein the plurality of sensors are configured to sense a parameter inside of the drilistring.

19. The method of detecting a downhole washout of claim 17, wherein the communicatively coupling includes connecting the plurality of sensors with wired pipe.

20. The method of detecting a downhole washout of claim 17, further comprising issuing an alert that a washout had occurred.

21. The method of detecting a downhole washout of claim 17, wherein positioning a plurality sensors includes positioning a plurality of pressure sensors.

* * * * *